US008752640B1

(12) United States Patent
Pottlitzer et al.

(10) Patent No.: US 8,752,640 B1
(45) Date of Patent: Jun. 17, 2014

(54) METHOD FOR DETECTING AND SUPPRESSING FIRE IN A CONTAINER

(75) Inventors: Brian Todd Pottlitzer, Louisville, KY (US); Roger Winton Pottlitzer, Louisville, KY (US); Daniel Tardiff, Shepherdsville, KY (US)

(73) Assignee: ULD Fire Systems, LLC, Louisville, KY (US)

( * ) Notice: Subject to any disclaimer, the term of this patent is extended or adjusted under 35 U.S.C. 154(b) by 295 days.

(21) Appl. No.: 13/179,983

(22) Filed: Jul. 11, 2011

Related U.S. Application Data

(60) Provisional application No. 61/374,774, filed on Aug. 18, 2010.

(51) Int. Cl.

| | |
|---|---|
| ***A62C 2/00*** | (2006.01) |
| ***A62C 3/00*** | (2006.01) |
| ***G08B 25/00*** | (2006.01) |
| *G08B 25/01* | (2006.01) |

(52) U.S. Cl.
CPC ..... *G08B 25/003* (2013.01); *G08B 25/014* (2013.01)
USPC ..... 169/46; 169/56; 169/60; 169/62; 239/211

(58) Field of Classification Search
CPC ..... A62C 3/002; A62C 3/08; A62C 99/0018; G08B 25/10; G08B 25/12; G08B 25/014; G08B 99/0018; G08B 99/0072
USPC ..... 169/60, 62, 46, 56; 239/211; 434/226
See application file for complete search history.

(56) References Cited

U.S. PATENT DOCUMENTS

| | | | | |
|---|---|---|---|---|
| 4,356,868 | A * | 11/1982 | Bentley et al. | 169/26 |
| 4,983,124 | A * | 1/1991 | Ernst et al. | 434/226 |
| 5,181,851 | A * | 1/1993 | Layton et al. | 434/226 |
| 5,518,402 | A * | 5/1996 | Tommarello et al. | 434/226 |
| 7,042,349 | B2 * | 5/2006 | Bergman et al. | 340/514 |
| 7,180,406 | B2 | 2/2007 | Berg | |
| 7,456,750 | B2 | 11/2008 | Popp et al. | |
| 7,510,022 | B2 * | 3/2009 | Lazzarini | 169/70 |
| 2009/0151965 | A1 | 6/2009 | Popp et al. | |

FOREIGN PATENT DOCUMENTS

| | | |
|---|---|---|
| FR | 2455726 | 5/1979 |
| FR | 2811456 | 7/2000 |
| JP | 2001080593 | 3/2001 |

* cited by examiner

*Primary Examiner* — Dinh Q Nguyen
(74) *Attorney, Agent, or Firm* — Camoriano & Associates

(57) ABSTRACT

A device and method for triggering the smoke detection system on a vessel in response to a fire inside a container housed in the vessel by providing a fire detection system inside the container and generating artificial smoke outside of the container in response to detecting fire inside the container.

5 Claims, 3 Drawing Sheets

METHOD FOR DETECTING AND SUPPRESSING FIRE IN A CONTAINER

BACKGROUND

This application claims priority from U.S. Provisional Application Ser. No. 61/374,774 filed Aug. 18, 2010.

The present invention relates to fire protection, and, in particular, to a device and method for protecting against fire in a container or unit load device (ULD) in the cargo hold of a vessel, such as an aircraft, railcar, or ship.

Goods to be transported in a vessel, particularly goods to be transported via aircraft, are usually loaded into containers (typically referred to as unit load devices (ULD's)), which are then loaded onto the vessel, in order to facilitate and speed up the loading and unloading process. It is possible for something in a ULD to ignite, with the smoke and heat of the fire being contained in the ULD, until it suddenly and explosively breaks out of the ULD and into the cargo hold. At that point, the fire could spread rapidly, which would create a dangerous situation.

While vessels currently have fire alarm and protection systems, those systems often do not sense the presence of a fire that is contained inside a container or ULD, which means that a fire could be smoldering for quite a while before it is detected, and, by the time it is detected, it may be such a large fire that it is difficult or impossible to suppress. For that reason, it would be desirable to modify or add to the existing systems to make them more effective at detecting and suppressing fires in containers or ULDs. However, modifications to an aircraft typically require full approval and recertification by a number of agencies which may include the aircraft manufacturer, the Federal Aviation Administration, and the US Department of Transportation, among others. There is also a concern about adding weight to the aircraft due to the modification, the cost of the modification itself, and the time required to install, and eventually to test and maintain, the modification.

It would be desirable to provide a device and method for automatically suppressing a fire inside a container (such as a ULD) while simultaneously alerting the fire alarm systems of the vessel, preferably without tying in electrically or mechanically, or otherwise in any way modifying the aircraft such that recertification is required. It would be preferable for such an automatic fire suppression and alarm system to be a totally passive system requiring no outside power (again, no tying into the aircraft systems) and no self-contained electrical power supply which has to be charged and which could, itself, be an ignition source.

SUMMARY

The present invention provides a device and a method for automatically detecting and suppressing a fire inside a container or ULD while simultaneously alerting the fire detection system on board the vessel (such as an aircraft) without requiring any modification of the vessel. In one embodiment, the device is a passive system that requires no battery supply or electrical source.

DESCRIPTION

Figure 1:
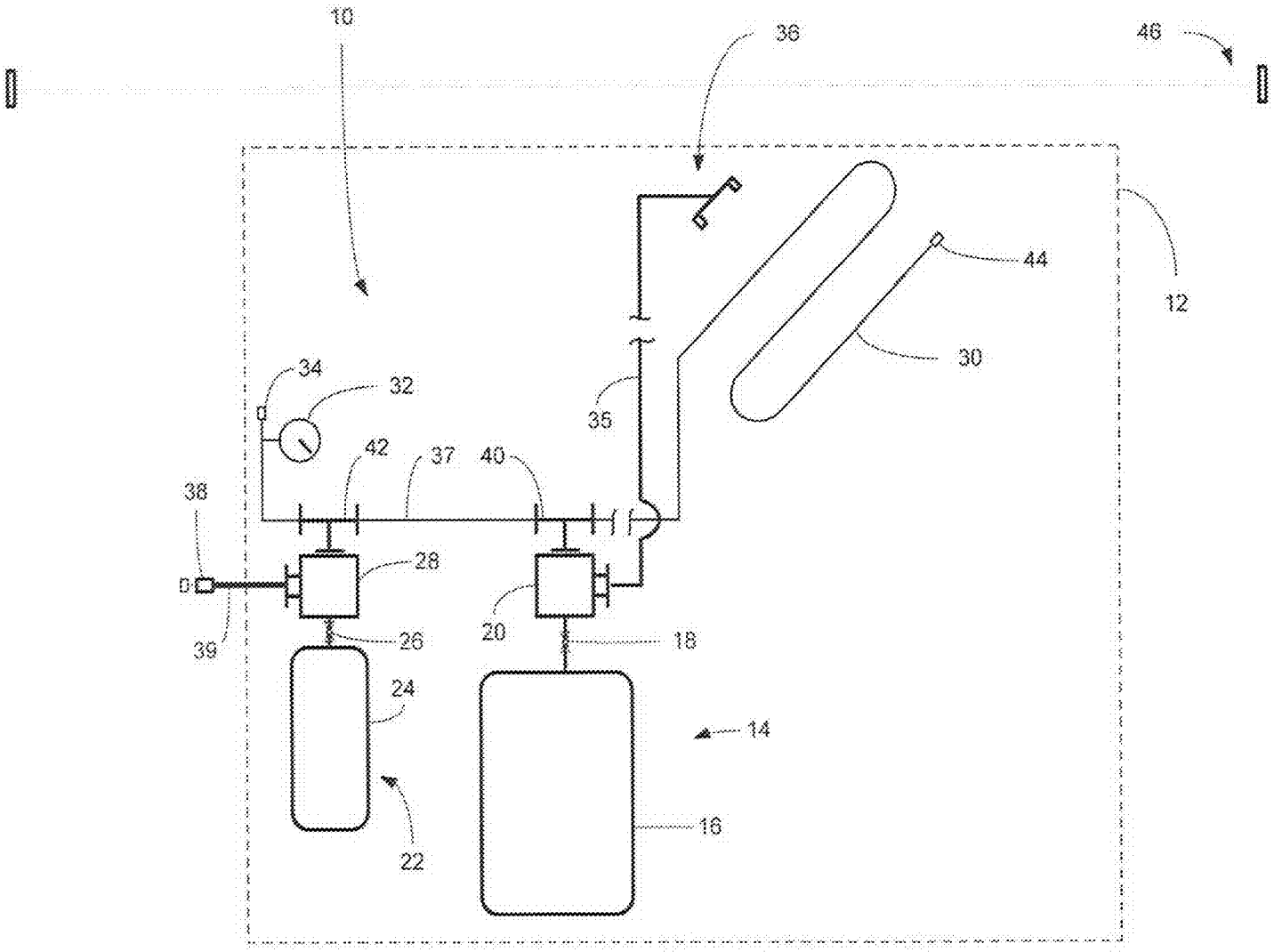
FIG. 1 is a schematic of an embodiment of an automatic fire detection, suppression and remote alarm system for a container or ULD.
Figure 2:
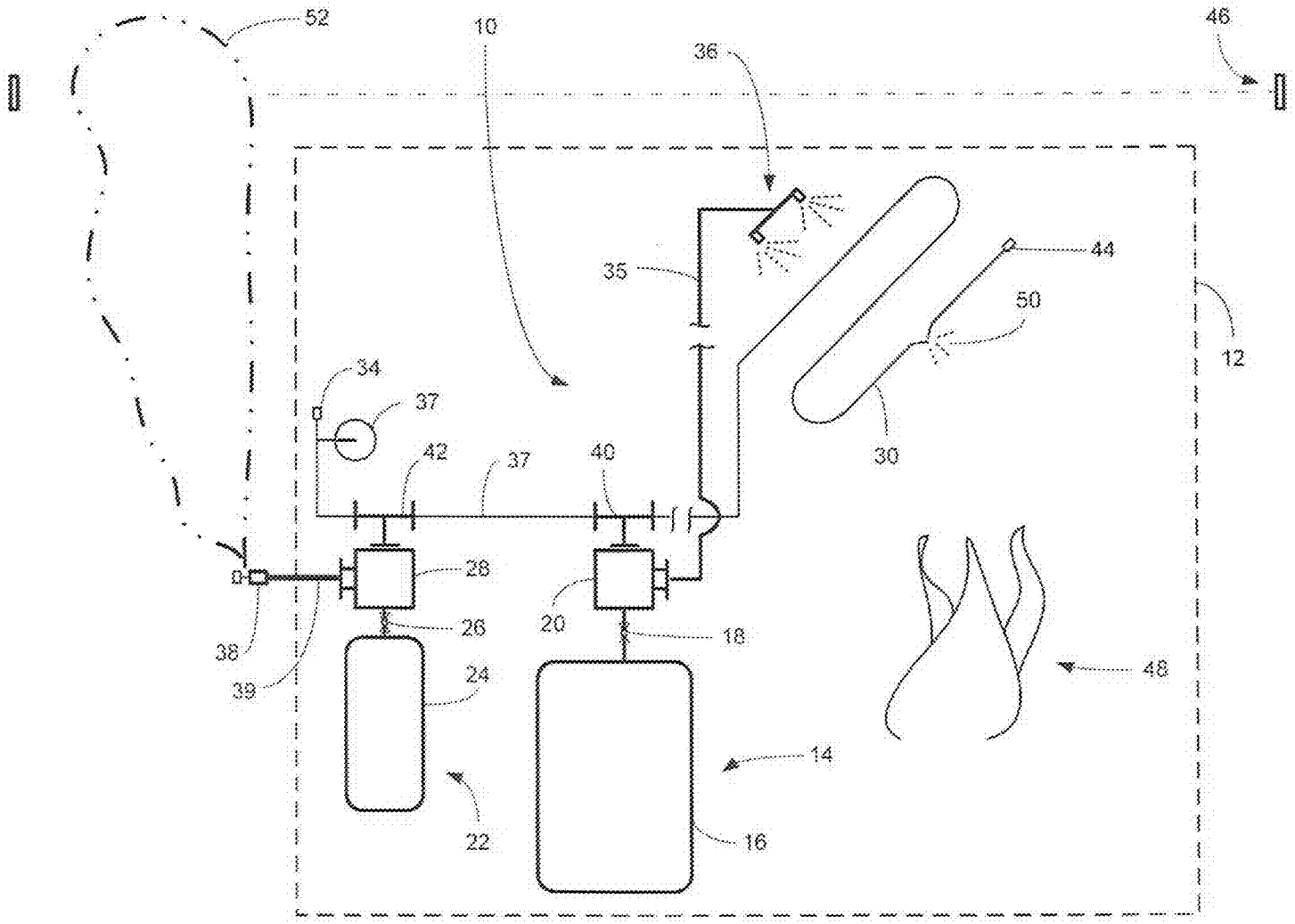
FIG. 2 is a schematic, identical to FIG. 1, but showing the system after it has been activated by a fire in the container.
Figure 3:
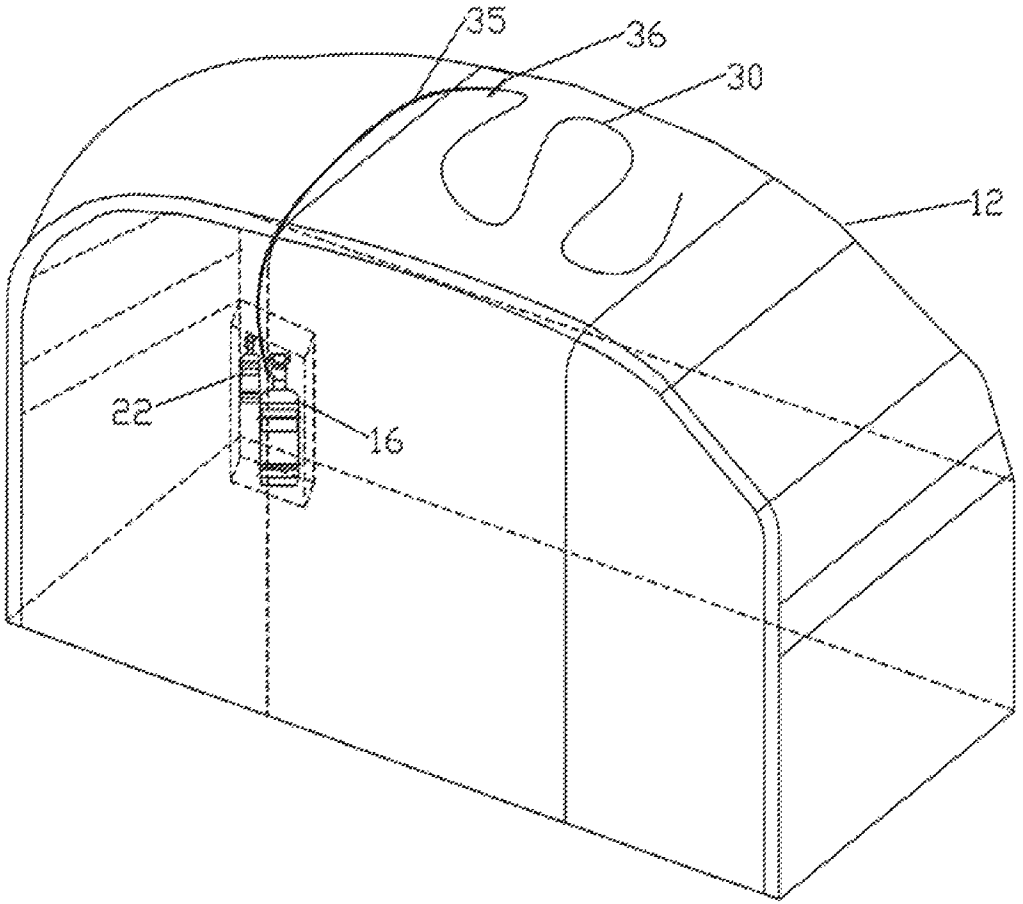
FIG. 3 is a schematic of the container and system of FIG. 1.

FIGS. 1-3 show one embodiment of an automatic fire detection, suppression and remote alarm triggering system for use in a container or ULD.

Referring to FIG. 1, the automatic fire detection, suppression, and remote alarm triggering system 10 is housed inside a container 12 (shown in dotted lines), which in this case is a ULD (unit load device) used for shipping products on an aircraft. The same system or a similar system could be used for containers to be used on other vessels, such as a ship, railcar, or truck, as well as for containers to be stored in a warehouse or other location. Products are loaded into the ULD, and then a plurality of loaded ULD's are loaded into the cargo hold of the aircraft. The aircraft itself is equipped with its own fire and smoke detection system 46 which triggers an alarm to alert the crew in the event that it detects a fire. The aircraft's fire and smoke detection system 46 also may trigger a fire suppression system, such as a sprinkler system (not shown) on the aircraft.

The automatic fire suppression and remote alarm triggering system 10 includes a fire suppression system 14 (including a pressurized fire suppressant canister 16, a shut off valve 18, and an outlet valve 20), a remote alarm triggering system 22 (including a pressurized smoke generating canister 24, a shut off valve 26, and an outlet valve 28), fire detection tubing 30, a system pressure indicator 32, an in-line adapter 34 to pre-charge the fire detection tubing 30, a fire suppressant discharge line 35 and nozzle assembly 36, and a smoke discharge nozzle assembly 38.

The fire suppression system 14, including the fire detection tubing 30, is commercially available from suppliers such as Firetrace International LLC of Scottsdale, Ariz., USA. The pressurized fire suppressant canister 16 contains a fire suppressant, such as FM-200 which is a hydrofluorocarbon-based (HFC 227) fire suppressant. This fire suppressant is held under a pressure in the pressurized canister 16 that is above atmospheric pressure, such that, when the shut off valve 18 is opened, the fire suppressant exits the pressurized canister 16 through the shut off valve 18 and the outlet valve 20 and line 35 and is delivered through the fire suppressant discharge nozzle assembly 36 to flood the ULD 12 with the fire suppressant.

The remote alarm triggering system 22 includes the pressurized smoke generating canister 24 which contains a non-pyrotechnic, non-toxic, non-corroding smoke generating powder and pressurized gas, such as nitrogen, carbon dioxide, air, or other gas or mixture of gases at a pressure above atmospheric pressure. One such smoke generating powder is sold as "Smoke Simulation Powder" by Major Paintall of Toccoa, Ga., U.S.A. Another is Grey or Red Simulation Powder sold by Combat Training Solutions of Colorado Springs, Colo., USA for use in land mine simulation devices. This smoke generating powder is a fine powder of solid particles held under pressure in the pressurized canister 24 such that, when the shut off valve 26 is opened, the fine particles and pressurized gas exit the pressurized canister 24 through the shut off valve 26 and the outlet valve 28, pass through the line 39 that extends through the wall of the ULD 12, and are expelled through the smoke discharge nozzle assembly 38, which is located outside of the ULD 12.

The fire detection tubing 30 is laid out, preferably along the ceiling of the ULD, and preferably along a grid or tortuous path, so it may readily detect any heat from a fire in the ULD 12. The fire detection tubing 30 is connected to the fire suppression system 14 through a line 37 to a first tee 40 and to the alarm triggering system 22 through the same line 37 to a second tee 42, and on to a system pressure indicator 32, and to an in-line adapter 34, which is used to pre-charge the fire detection tubing 30 to the desired pressure, as described in more detail later. The fire detection tubing 30 also includes a cap 44 at the distal end of the fire detection tubing 30 to close off that end to allow the tubing 30 to be pressurized.

The line 37 and fire detection tubing 30 form a sealed body, which has an internal pressure that is above atmospheric pressure. The fire detection tubing 30 is made of a material that fails at a certain temperature, so it serves as a type of thermal fuse in fluid communication with the interior of the sealed body. Other types of thermal fuses are known and could be used instead of or in addition to the fire detection tubing 30. For example, one or more thermal plugs (not shown) could be installed in the line 37 to serve as a thermal fuse, and, if desired, the line 37 could follow the same path as the tubing 30, with thermal plugs installed at intervals along the line 37. (Thermal fuse plugs are made of a material that melts or fails at a certain desired temperature that represents the temperature at the onset of a fire.)

The fire detection tubing 30 may be run inside a "C" channel (not shown) or inside some other protective structure to prevent accidental tearing or snagging of the tubing 30 when the ULD 12 is being loaded, without shielding or otherwise interfering with the exposure of the tubing 30 to a heat source.

The sealed body defined by the line 37 and the fire detection tubing 30 is designed to be pressurized with a gas. In this embodiment, the compressed gas is nitrogen. Other gases could be used instead, such as, but not limited to, carbon dioxide, argon, or air or various mixtures of gases. A desirable pressure is in the range of 150 to 200 psi (10 to 13 bar), although other pressures could be used. At this pressure, the fire detection tubing 30 is designed to rupture at approximately 180 degrees Fahrenheit with flame infringement (within 30 inches (76 cm)), or at approximately 275 degrees Fahrenheit with no flame infringement. The fire detection tubing 30 is initially pressurized by connecting a source of pressurized gas, such as a compressed gas canister or compressor (not shown) to the in-line adapter 34. The pressure indicator 32 allows the operator to visually check that the fire detection tubing 30 has been pressurized to the desired pressure. The source of compressed gas is removed once the tubing 30 has been pressurized. The type of fire detection tubing 30 and the pressure to which it is pressurized may be adjusted depending upon the desired detection level.

As indicated earlier, the pressurized gas is contained within the sealed body defined by the line 37 and the fire detection tubing 30 and is in fluid communication with all of the fire detection tubing 30 and with the line 37 from the in-line adapter 34 to the end cap 44, and all points in between, including the pressure indicator 32, and the top portions of the outlet valves 20, 28 via the tees 40, 42.

Each outlet valve 20, 28 is a pressure balanced valve which remains tightly closed to prevent the discharge of the contents of the pressurized canisters 16, 24, respectively, as long as there is a counterbalancing pressure above the outlet valve 20, 28. As discussed above, the sealed body defined by the line 37 and the fire detection tubing 30 is pressurized to provide that counterbalancing pressure to the outlet valves 20, 28 to keep them tightly closed.

During initial installation, the automatic fire suppression and remote alarm triggering system 10 is placed inside the ULD 12 with the smoke discharge nozzle assembly 38 projecting through the wall of the ULD 12, as shown in FIG. 1. The proximal end of the smoke discharge nozzle assembly 38 is in fluid communication with the contents of the pressurized gas producing canister 24 via the outlet valve 28 and line 39.

The fire detection tubing 30 is routed inside the ULD 12, preferably along the ceiling of the ULD 12 and, as stated earlier, along a tortuous path so it may readily detect any heat from an ignition source in the ULD 12. At this time, the shut off valves 18, 26 are in the closed position to prevent any discharge of the contents from the pressurized canisters 16, 24, respectively.

Once the system is installed, the sealed body formed by the line 37 and the fire detection tubing 30 is pressurized to the desired pressure which is sufficient not only to maintain the outlet valves 20, 28 closed against the pressure of the contents in the pressurized canisters 16, 24, but also to stretch the wall of the fire detection tubing 30 the desired amount so that it will rupture at the target temperature when exposed to a heat source, as described above. The fire detection tubing 30 is pressurized via the in-line adapter 34 until the pressure indicator 32 reads the desired target pressure. The fire suppressant discharge nozzle assembly 36 is also mounted, preferably to the ceiling of the ULD 12, to enhance its capability to flood the interior of the ULD 12 with a fire suppressant chemical. The proximal end of the fire suppressant discharge nozzle assembly 36 is in fluid communication with the contents of the pressurized fire suppressant canister 16 via the outlet valve 20 and line 35.

Once the installation is complete and the fire detection tubing 30 is pressurized, the shut off valves 18, 26 are opened. The contents of the pressurized canisters 16, 24 will not be discharged at this point, because the respective outlet valves 20, 28 are closed due to the counterbalancing pressure exerted by the pressurized gas in the fire detection tubing 30. The ULD 12 may now be loaded and placed into the cargo hold of the aircraft.

In the event of a fire inside the ULD 12, as shown schematically in FIG. 2, the heat from the fire 48 causes the fire detection tubing 30 to rupture at the point 50, which allows the pressurized gas inside the fire detection tubing 30 to be released through the rupture 50, thereby dropping the pressure inside the fire detection tubing 30 to a level which results in the outlet valves 20, 28 shifting to their fully open positions. As the outlet valve 20 to the fire suppression canister 16 opens, it releases the fire suppressant from the pressurized canister 16, delivering it to the fire suppressant discharge nozzle assembly 36, which floods the interior of the ULD 12 with the fire suppressant.

At the same time, the outlet valve 28 to the smoke producing canister 24 also opens, releasing the smoke generating powder and pressurized gas from the pressurized canister 24, expelling it through the smoke discharge nozzle assembly 38 immediately outside the ULD 12. The expelled smoke generating powder forms a rising cloud 52 of non-pyrotechnic, artificial smoke outside the ULD 12. This cloud of smoke 52 is sensed by the smoke detection system 46 of the vessel, which immediately sends an alert to the crew, advising them of the fire condition. It also may trigger an existing fire suppression system on the vessel, such as a Halon System on an aircraft (not shown). Other types of existing fire suppression systems on a vessel that could be triggered by the smoke detection system on the vessel may include a sprinkler system or other known vessel fire suppression systems.

Thus, this embodiment senses a fire inside the container or ULD 12, triggers a fire suppression system 14 within the ULD 12, and generates a cloud of artificial smoke outside the ULD 12, which is sufficient to trigger the existing smoke detection system 46 of the vessel.

While the embodiment described above shows one arrangement for a fire suppression system with remote alarm triggering, it will be obvious to those skilled in the art that modifications could be made to this arrangement without departing from the scope of the present invention as claimed.

For instance, the fire suppression portion of the device may be omitted, leaving only the smoke generating system 22 portion of the device. While some examples of smoke-generating powder have been described, there are many different particulates as well as other types of smoke-generating chemicals that could be used as an alternative to create an artificial smoke cloud that would be sufficient to trigger the existing smoke detection system 46 on the vessel. Also, it would be possible to house some of the components, such as the canisters 16, 24, outside of the ULD rather than inside, if desired, as long as the fire detection tubing 30 and the fire suppressant discharge nozzle assembly 36 are inside the ULD 12.

It also would be possible to use a simple alternative arrangement in which a pressurized canister containing smoke-generating powder has a valve that is held in the closed position by a thermal plug located inside the ULD, wherein, when the thermal plug melts, the valve is pushed open by the internal pressure in the canister and releases the pressurized powder outside the ULD to trigger the smoke detector on the vessel. A pressurized canister of the type shown in FIGS. 4-6B of U.S. Pat. No. 7,456,750 "Popp" (which is hereby incorporated herein by reference) could be used for this purpose, except that, instead of being filled with pressurized fire suppression material which is released into the ULD when the thermal plug melts, it would be filled with pressurized artificial smoke, which would be released outside of the ULD when the thermal plug melts.

Also, while the use of a thermal fuse for detecting fire inside the ULD is preferred, other known methods and systems of fire detection could alternatively be used inside the ULD to trigger the release of artificial smoke outside of the ULD.

What is claimed is:

1. A method for triggering a smoke detection system on a vessel in the event of a fire within a container housed in the vessel, comprising the steps of:

using a fire detection system inside the container to detect the fire inside the container;

releasing artificial smoke outside the container and inside the vessel in response to the detection of the fire inside the container by the fire detection system; and using the artificial smoke to trigger the smoke detection system on the vessel.

2. A method for triggering a smoke detection system on a vessel in the event of a fire within a container housed in the vessel as recited in claim 1, wherein said artificial smoke is a non-pyrotechnic powder.

3. A method for triggering a smoke detection system on a vessel in the event of a fire within a container housed in the vessel as recited in claim 1, wherein the step of releasing artificial smoke in response to the detection of the fire inside the container includes providing a sealed body having a pressurized interior; using a thermal fuse to unseal the sealed body in response to a high temperature caused by the fire inside the container, thereby causing the pressure in the interior of the sealed body to change; and using non-electrically-powered means in fluid communication with the interior of the sealed body to release the artificial smoke in response to the pressure change in the sealed body.

4. A method for triggering a smoke detection system on a vessel in the event of a fire within a container housed in the vessel as recited in claim 3, wherein said sealed body includes heat detection tubing, which also serves as said thermal fuse.

5. A method for triggering a smoke detection system on a vessel in the event of a fire within a container housed in the vessel as recited in claim 3, and further comprising the step of:

releasing a fire suppressant inside the container in response to the pressure change in said sealed body.

* * * * *